US005451483A

United States Patent [19]

Fuller et al.

[11] Patent Number: 5,451,483

[45] Date of Patent: Sep. 19, 1995

[54] LIQUID DEVELOPER COMPOSITIONS

[75] Inventors: Timothy J. Fuller, Pittsford; Ralph A. Mosher, Rochester; John S. Berkes, Webster; John S. Chambers, Rochester; James R. Larson, Fairport, all of N.Y.

[73] Assignee: Xerox Corporation, Stamford, Conn.

[21] Appl. No.: 268,608

[22] Filed: Jun. 30, 1994

[51] Int. Cl.[6] ..... G03G 9/13

[52] U.S. Cl. ..... 430/114; 430/117; 430/115

[58] Field of Search ..... 430/114, 115, 117, 124

[56] References Cited

U.S. PATENT DOCUMENTS 3,993,483 11/1976 Maki et al. ..... 430/114
4,707,429 11/1987 Trout ..... 430/115
5,019,477 5/1991 Felder ..... 430/115
5,030,535 7/1991 Drappu et al. ..... 430/116
5,035,972 7/1991 El-Sayed et al. ..... 430/114
5,290,653 3/1994 Pearlstine ..... 430/114

FOREIGN PATENT DOCUMENTS 49-21666 6/1974 Japan ..... 430/114

*Primary Examiner*—Christopher D. Rodee
*Attorney, Agent, or Firm*—E. O. Palallo

[57] ABSTRACT

A liquid developer comprised of a nonpolar liquid, thermoplastic resin particles comprised of a polyalkylene or polyalkylene with pendant acid or ammonium groups thereon, optional pigment, optional charge adjuvant and charge director.

9 Claims, No Drawings

LIQUID DEVELOPER COMPOSITIONS

BACKGROUND OF THE INVENTION

This invention is generally directed to liquid developer compositions containing resin particles, charge adjuvants, optional pigments, and charge directors. More specifically, the present invention relates to liquid developers comprised of a suitable carrier liquid and poyalkylene particles, such as polybutene, polypentene, polypentadecene, and the like, and which developers are suitable for imaging processes including those processes that involve the transfer of developed images from one substrate to another by a process referred to as transfix. In particular, copolymers and terpolymers of 1-butene, 1-pentene, and undecylenic acid were found to possess excellent release characteristics and transfix well from VITON B50® and VITON GF® intermediates which represents a stress situation for transfix. Resins for liquid development can require a number of very specific attributes, including for example processable into particles with the desired melting properties, usually between about 60° and about 120° C.; be hydrocarbon swellable or soluble at elevated temperatures but insoluble at temperatures less than about 60° C.; plasticizable with hydrocarbons developable by electrostatic or other imaging processes; releasable from low surface energy elastomers; adherent to paper and plastic films; and optically clear, and mechanically robust. These and other needs are achievable with the liquid toners of the present invent on in embodiments. Also, liquid developers with the polyalkyene resins of the present invention possess superior release and transfer characteristics from, for example, VITON® intermediates to SENECA IMAGE SERIES LX™ and coated papers like KROME KOTE™ materials, as compared to other known resins such as NUCREL 599® selected for liquid developers. With respect to release and transfix, the polyalkylene resins are comparable with or superior to the amine and ester modified NUCREL 599® resins illustrated in copending patent application Ser. No. 185,343 (D/93428), the disclosure of which is totally incorporated herein by reference. The polyalkylene resins selected for the developers of the present invention possess unique release properties which allow efficient transfix from VITON® intermediates. Moreover, in embodiments the polyalkylene resin structure can be modified to control the triboelectrical characteristics and melting properties of the developer particles.

The images obtained with developers comprised of the polyalkylene resin particles of the present invention can be developed onto a photorecepter and, subsequently, can be transferred to an intermediate substrates for optional image conditioning before the image is again transferred and permanently adhered to or fixed to the final image receiver, such as paper or plastic film, using heat and pressure means such as rollers. The intermediate substrate is typically comprised of a informable elastomer, such as VITON®, silicone, fluorosilicone, polyphosphazene, fluoropolymer, or a related material with low surface energy to facilitate release. Alternatively, the liquid images can be applied directly to a low surface energy intermediate by known printing methods, silk screening techniques, and the like prior to optional image conditioning, subsequently transferring from the intermediate, and subsequently fixing to the final image receiver which is usually paper. Image conditioning of developed images entails, for example, the heat treatment and blotting of the developed liquid images on an intermediate to form high ink solids images, for example, between 1 and about 100 percent solids of the nonliquid, dry weight of the inks.

The liquid images formed with the developers of the present invention enable improved release from intermediates, and effective transfer and transfix of developed images to the image receiver with improved copy quality. Copy quality improves primarily as a result of the optically clear polyalkylene resins, small particle size developers, low image pile height, and low fixing temperatures which enable image permanence and reduced paper curl.

When electrostatic development is selected for the preparation of images, additional characteristics can include resin particles with appropriate charging properties to permit high resolution images which can be electrostatically transferred to the appropriate intermediate. NUCREL® resins which are comprised of ethylene-methacrylic acid copolymers have traditionally been used in liquid developers. These resins have excellent triboelectrical properties and acceptable fix, or permanence, and acceptable image quality in most instances. However, the adhesion of NUCREL® particles to intermediates can render these resins unsatisfactory in transfix processes, that is, for example, for release from intermediates and subsequent transfer to paper. The resins of the present invention enable, for example, the facilitation of the release of images from intermediate substrates without adversely affecting image permanence and image quality.

With the polyalkylene resins as illustrated herein, there are enabled liquid and dry developers with small particle sizes, for example, particles with average volume diameters of between 0.2 and 10 microns, which resins can be obtained by conventional shot mill attrition within about 6 hours; and excellent and improved toner release from, for example, intermediate substrates, and wherein the resulting developed images can be transfixed to substrates such as paper. The developers of the present invention can be selected for a number of known imaging systems, such as xerographic imaging and printing processes, wherein latent images are rendered visible with the liquid developer illustrated herein. The image quality, solid area coverage and resolution for developed images usually require, for example, sufficient toner particle electrophoretic mobility. The mobility for effective image development is primarily dependent on the imaging system used, and this electrophoretic mobility is directly proportional to the charge on the toner particles and inversely proportional to the viscosity of the liquid developer fluid. For example, a 10 to 30 percent change in fluid viscosity caused for instance by a 5° to 15° C. decrease in temperature could result in a decrease in image quality, poor, or unacceptable image development and undesirable background development, for example, because of a 5 percent to 23 percent decrease in electrophoretic mobility. Insufficient particle charge can also result in poor, or no transfer of the toner to paper or other substrates. Poor transfer, for example, can result in poor solid area coverage if insufficient toner is transferred to the final substrate and can also result in image defects such as smearing and hollowed fine features. To overcome or minimize such problems, the liquid toners of the present invention were arrived at after substantial efforts, and which toners result in, for example, sufficient particle charge, generally corresponding to an ESA mobility greater than 1.5 E-10 $m^2/Vs$ for excellent transfer, maintaining their mobility within the desired range of the particular imaging system employed, and the developer conductivity thereof is usually maintained between 5 and 20 ps/centimeter. Other advantages associated with the developers of present invention include the use of certain polyalkylene resins particles for satisfactory development and improved transfix.

The polyalkylene resins can be chemically modified with undecylenic acid groups and related derivatives by copolymerization with undecylenic acid, undecylenyl iodide, and the like, and subsequent derivatization to form quaternary ammonium groups to improve the respective negative or positive charging properties of the developer. The concentration of functional groups attached to the alkylene copolymers range from between about 0.1 and about 25 weight percent and preferably from between about 1 and 15 weight percent.

Specific alkylene copolymers of the present invention include the following: polybutene with between 0.5 and 25 weight percent of undecylenic acid groups, polybutene with between 15 and 20 weight percent of pentene and with between 0.5 and 25 weight percent of undecylenic acid groups, polypentene with between 0.5 and 25 weight percent of undecylenic acid groups, and the like. Similar compounds with quarternary ammonium groups derived from undecylenic acid or undecylenyl iodide can also be used in place of undecylenic acid to control the charging properties of the toners.

A latent electrostatic image can be developed with toner particles dispersed in an insulating nonpolar liquid. The dispersed materials are known as liquid toners or liquid developers. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems.

Typical liquid developers can comprise a thermoplastic resin and a dispersant nonpolar liquid. Generally, a suitable colorant, such as a dye or pigment, is also present in the developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 30 $\mu$m (microns) and, for example, from about 5 to about 25 microns average by area size as measured with the Matvern 3600E particle sizer or from about 0.2 to about 10 microns (area average diameter) as measured with the Horiba CAPA 500 or 700 centrifugal particle size analyzer.

Since the formation of proper electrostatic images depends on the difference of the charge between the toner particles in the liquid developer and the latent electrostatic image to be developed, it is desirable to add a charge director compound and optional charge adjuvants (charge control agent) ,which increase the magnitude of the charge, such as polyhydroxy compounds, amino alcohols, polybutylene succinimide compounds, aromatic hydrocarbons, metallic soaps, and the like, to the liquid developer comprising the thermoplastic resin, the nonpolar liquid and the colorant. A charge director can be of importance in controlling the charging properties of the toner to enable excellent quality images. Also, the hydrocarbon side chains of the polyalkylene resin particles selected enables, in of themselves, improved image toner release from a number of substrates.

In U.S. Pat. No. 5,035,972, the disclosure of which is totally incorporated herein by reference, there are illustrated liquid developers with unmodified resins and quaternized ammonium AB diblock copolymer charge directors, and wherein the nitrogen in the ionic A block is quaternized with an alkylating agent.

U.S. Pat. No. 5,019,477, the disclosure of which is totally incorporated herein by reference, illustrates a liquid electrostatic developer comprising a nonpolar liquid, unmodified thermoplastic resin particles, and a charge director. The ionic or zwitterionic charge directors may include both negative charge directors such as lecithin, oil-soluble petroleum sulfonate and alkyl succinimide, and positive charge directors such as cobalt and iron naphthenates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene, and (iv) selected from the group consisting of butadiene and acrylate. As the copolymer of polyethylene and methacrylic acid or methacrylic acid alkyl esters, NUCREL® may be selected. Disadvantages associated with the aforementioned liquid developers are as indicated herein and include, for example, poor toner release, in many instances between 0 and 30 percent image transfer from substrates, and difficulty in grinding particles to dimensions of less than 2 microns, and preferably from submicron to about 2 microns volume average diameter, as determined using the Horiba CAPA 500 or 700 particle size analyzer.

U.S. Pat. No. 5,030,535 discloses liquid developer compositions comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

Although the developers of the U.S. Pat. No. 5,030,535 can be sufficient for their intended purposes, a number of problems relating to triboelectrical charging and copy quality thereof were encountered when colorants other than carbon black were used. Specifically, developers prepared with many polyolefin resins without functional groups are difficult to charge triboelectrically even in combination with known charge adjuvant compounds when the developer particles are prepared with colorants other than carbon black. Also, carbon black was found to have a substantial effect on the triboelectrical properties and image quality of the poly-1-olefin developers of the '535 patent. Certain long chain poly-1-olefins like poly-1-hexadecene, poly-1-octadecene, and the like of the 5,030,535 patent demonstrate excellent release from VITON® intermediates; however, the images without carbon black fillers were greasy and prone to smear (like crayons). Poly-1-pentene, poly-1-butene, and poly-1-pentadecene developers prepared in accordance with the 5,030,535 patent were found to have excellent release from VITON® intermediates and the images were not greasy. However, developer charging remained a problem when colorants other than carbon black were used. Thus, new polyalkylene resins for liquid developers were needed which possessed improved image quality for the production of high resolution color images. The polyalkylene developers of the instant invention offer improved developer charging properties with most colorants in addition to carbon black, and provide improved copy quality without adversely affecting the release of toned images in transfix.

U.S. Pat. No. 4,707,429 discloses, for example, liquid developers with unmodified resins, and an aluminum stearate charge adjuvant. Liquid developers with charge directors are illustrated in U.S. Pat. No. 5,045,425.

U.S. Pat. No. 4,952,477 discloses dry xerographic toner and developer compositions containing semicrystalline polyolefin resins, while U.S. Pat. No. 5,030,535 teaches liquid developer compositions containing polyolefin resins. U.S. Pat. No. 5,166,026 (D/89062) teaches dry toner resins containing eicosene polymers with iodo, quaternary ammonium, amino, and amide functionalities. The disclosures of each of these patents and other patents mentioned herein relating to liquid developers are totally incorporated herein by reference.

In copending patent application Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., the developer having a melting point of at least about 25° C., the contact occurring while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

In U.S. Pat. No. 5,306,591 (D/92570), and U.S. Pat. No. 5,308,731, the disclosures of which are totally incorporated herein by reference, there is illustrated a liquid developer comprised of unmodified thermoplastic resin particles, a charge director, and a charge adjuvant comprised of an imine bisquinone; and a liquid developer comprised of a liquid, unmodified thermoplastic resin particles, a nonpolar liquid soluble charge director, and a charge adjuvant comprised of a metal hydroxycarboxylic acid, respectively. The charge adjuvants and other appropriate components of these patents may be selected for the liquid toners of the present invention.

In copending patent application Ser. No. 065,414, the disclosure of which is totally incorporated herein by reference, there is illustrated a liquid developer comprised of thermoplastic resin particles, and a charge director comprised of an ammonium AB diblock copolymer of the formula

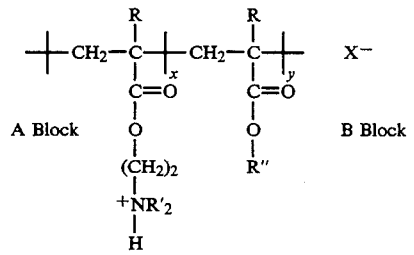

wherein $X^-$ is a conjugate base or anion of a strong acid; R is hydrogen or alkyl; R' is alkyl; R'' is an alkyl group containing from about 6 to about 20 carbon atoms; and y and x represent the number average degree of polymerization (DP) wherein the ratio of y to x is in the range of from about 10 to 2 to about 100 to 20.

In copending application Ser. No. 185,343, there are illustrated liquid developers with ester, or amide modified resins. Liquid developers prepared with amide and ester modified resins offer improved release compared with NUCREL 599® control resin. Advantages of the economical alkylene resins over the aforementioned amide and ester modified resins include unique and improved performance, and superior releach characteristics in embodiments.

Illustrated in U.S. Pat. No. 5,409,796, the disclosure of which is totally incorporated herein by reference, is a positively charged liquid developer comprised of thermoplastic resin particles, optional pigment, a charge director, and a charge adjuvant comprised of a polymer of an alkene and unsaturated acid derivative; and wherein the acid derivative contains pendant ammonium groups, and wherein the charge adjuvant is associated with or combined with said resin and said optional pigment; in application Ser. No. 204,012, the disclosure of which is totally incorporated herein by reference, is a negatively charged liquid developer comprised of thermoplastic resin particles, optional pigment, a charge director, and an insoluble charge adjuvant comprised of a copolymer of an alkene and an unsaturated acid derivative, and wherein the acid derivative contains pendant fluoroalkyl or pendant fluoroaryl groups, and wherein the charge adjuvant is associated with or combined with said resin and said optional pigment; and in application Ser. No. 204,016, the disclosure of which is totally incorporated herein by reference, is a liquid developer comprised of thermoplastic resin particles, optional pigment, and a charge director comprised of a mixture of an organic anionic complex phosphate ester and organic aluminum complex, or mixtures thereof of the formulas

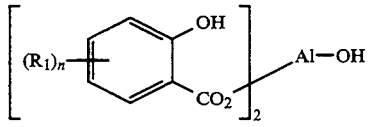

or

-continued

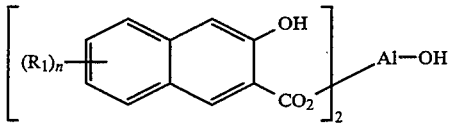

wherein $R_1$ is selected from the group consisting of hydrogen and alkyl, and n represents a number.

The disclosures of each of the patents and the copending patent applications recited are totally incorporated herein by reference.

SUMMARY OF THE INVENTION

It is an object of the present invention to provide a liquid developer with many of the advantages illustrated herein.

Another object of the present invention resides in the provision of a liquid developer capable of high particle charging with various different colorants.

It is a further object of the invention to provide a liquid developer wherein there are selected polyalkylene resins to primarily enable excellent release of toned liquid immersion images from intermediate substrates to, for example, coated papers.

Another object of the present invention resides in the ability to attrite liquid and dry developer particles rapidly, for example in less than, or equal to about 6 hours, and more specifically, from about 2 to about 5 hours to tailored dimensions with volume average radii between about 0.1 and 2 microns by conventional shot mill attrition methods, use of a microfluidizer (Microfluidics) or the use of a piston homogenizer (NiroSoavi).

Another object of the present invention resides in the provision of liquid developers with known additives and adjuvants with improved electrical charging properties for color imaging, and excellent transfix with, for example, coated papers.

These and other objects of the present invention can be accomplished in embodiments by the provision of liquid developers with certain resin particles. In embodiments, the present invention is directed to liquid developers comprised of a polyalkylene toner resin, pigment, an optional charge adjuvant, and an optional charge director comprised, for example, of certain protonated ammonium AB diblock copolymers.

In embodiments, the present invention is directed to a liquid developer comprised of a nonpolar liquid, thermoplastic resin particles comprised of a polyalkylene, or polyalkylene with pendant acid or ammonium groups thereon, optional pigment, optional charge adjuvant and charge director; and a liquid developer comprised of polyalkylene thermoplastic resin particles, a liquid component, pigment, a-charge adjuvant and a charge director.

Polyalkylene toner resins include those with a carbon chain length, or mixed carbon chain lengths, of from about 3 to about 30, and preferably from 4 to about 11; with a number average molecular weight (Mn) of from about 10,000 to about 1,500,000, as determined by size exclusion chromatography, and a weight average molecular weight ($M_w$) to $M_n$ polydispersity ratio of from about 1 to about 15.

NUCREL 599® is one of the preferred resins selected for liquid inks or liquid developers. However, images obtained with NUCREL 599® fail to effectively transfer or transfer poorly from VITON® intermediates to coated papers like KROME KOTE TM, a stress situation, it is believed, for transfix. In contrast, the developers of the present invention with, for example, poly-1-butene, polypentene, polypentadecene, and the like, possess improved release and transfix to KROME KOTE TM paper.

There has been prepared and evaluated the transfix performance of more than 60 cyan inks derived from the following classes of materials: ethylene-methyl acrylate, polycycloolefins, poly-1-olefins, ethylene-vinyl acetate, ethylene acrylic acid, ethylene-methacrylic acid, polyesters, polystyrenes, polyvinyl acetate, and polyvinyl butyral. Of these, the preferred materials not related to NUCREL® and which have excellent transfix to KROME-KOTE TM paper are the polyalkylene resins derived from 1-butene, 1-pentene, undecylenic acid, undecylenic acid derivatives, undecylenyl iodide, undecylenyl with pendant quaternary ammonium groups, poly-1-pentadecene, and the like.

Polyalkylenes, which are available, can be prepared by polymerization of olefins, especially the 1-olefins such as 1-butene, 1-pentene, undecylenic acid-trimethylsilyl ester, and the like, using an isotactic catalyst, especially $TiCl_3$ AA/diethylaluminum chloride in toluene. Undecylenic acid-trimethylsilyl ester was, for example, prepared from the reaction of undecylenic acid with trimethylsilyl chloride; undecylenyl iodide was prepared from undecylenol; and undecylenol was allowed to react with thionyl chloride and pyridine to form undecylenyl chloride which was then converted to undecylenyl iodide by reaction with sodium iodide in acetone or methyl ethyl ketone. Undecylenyl triethylammonium iodide was formed by the reaction of undecylenyl iodide and triethylamine in alcohol.

Developed images generated with copolymers and terpolymers of the polyalkylenes of the present invention, especially 1-butene, 1-pentene, and undecylenic acid, effectively release and transfix from VITON B50® and VITON GF® intermediates to ISLX paper. VITON B50® represents a stress situation, it is believed, for transfix. The release of the inks of the present invention in embodiments is between 3 and 25 times superior to that of a similar control ink containing NUCREL 599®.

The resins prepared and evaluated as cyan liquid developers contain the components summarized in Table 1, such as poly-1-butene, poly-1-pentene, poly-1-pentadecene, poly(97 weight percent-1-pentene-3 weight percent-undecylenic acid), 13poly(88 weight percent- 1 -butene- 12 weight percent-undecylenic acid), poly(78 weight percent-1-butene-22 weight percent-undecylenic acid), poly(82 weight percent-1-butene-15 weight percent-1-pentene-3 weight percent-undecylenic acid), and poly(77 weight percent-1-butene-20 weight percent-1-pentene-3 weight percent-undecylenic acid). The charging properties of the cyan inks prepared with the above-mentioned polyalkylene resins are comparable with cyan ink prepared with NUCREL 599®, reference Table 1. In general, those inks with ESA mobilities greater than 1 E $-10$ $m^2/V$ second and with zeta potentials greater than 100 millivolts are expected to develop well in liquid development systems such as the Savin 870 photocopier. Image transfix data is also provided in Table 1. In all situations reported, the polyalkylene resin developers are superior to that of NUCREL 599® used as a control. In particular, the polybutene-undecylenic acid based inks were used to prepare nonsmearing, transfixable inks. These materials demonstrate excellent release from VITON GF ® intermediate substrates, and transfused images do not have the greasy, slippery feel common to other resins. The terpolymers, poly-1-butene-(with between 15 and 20 weight percent)-1pentene and with 3 weight percent-undecylenic acid groups, have appropriate melting points near 70° C. and demonstrate excellent transfix and acceptable image quality in transfix tests. The ESA-charging of these LID ink materials is comparable to a cyan NUCREL 599 ® control ink.

Liquid immersion development inks can be prepared a number of known methods including, for example, by adding 80 weight percent of the polyalkylene thermoplastic resin, 3 weight percent WITCO 22 TM (aluminum stearate charge control agent, 0.78 gram, Witco Chemical), PV FAST BLUE TM (5.19 grams, American Hoechst-Celanese, Conventry, RI) and ISOPAR L TM or NORPAR 15 TM (170 grams, Exxon) to a Union Process 01 attritor with 2,400 grams of ⅜ inch shot. The contents were heated to 200° F. with jacketed steam for about 10 minutes with stirring. Heating was then discontinued and stirring with unregulated temperature control between 60° and 25° C. was maintained for two hours. Jacketed cooling water was then used to chill the contents of the attritor to between 15° and 25° C., and stirring was maintained for an additional four hours. The contents of the attritor were then sieved to remove the grinding media which were then washed with ISOPAR L TM or NORPAR 15 TM. All the resulting liquid portions were combined to form a cyan electrophoretic liquid immersion development ink. The percent solids, which solids are comprised of resin (20 grams), WITCO 22 TM charge adjuvant (0.78 gram) and PV FAST BLUE TM (5.19 grams), and suspended in about 551.4 grams of ISOPAR L TM or NORPAR 15 TM with optional charge director in embodiments were determined with weighed 6 gram samples of ink that were heated with a sun lamp until all the ISOPAR L TM evaporated, that is, when a constant dry sample weight was obtained usually after at least 24 hours in a suitable protected hood.

The polyalkylene thermoplastic toner resins of the present invention and obtained, for example, by the Ziegler-Natta polymerization of 1-butene, 1-pentene, undecylenic acid and the like, can be selected for the liquid developers of the present invention in effective amounts of, for example, in the range of about 99 percent to about 40 percent, and preferably about 95 percent to about 70 percent of developer solids, which solids are comprised of thermoplastic resin, pigment, charge adjuvant, and in embodiments other components such as pigments, magnetic materials like magnetites and the like.

Transfix of the liquid developers was accomplished by first concentrating the liquid inks by centrifugation to 9.2 weight percent solids in ISOPAR L TM. Then, 3 parts of the polyalkylene were added per part of resin solids. The resultant ink was gravure draw-bar coated onto an intermediate substrate of VITON GF ®, VITON B50 ® or silicone coated onto stainless steel shimstock. The ink image on the intermediate was dried in an oven for 6 minutes at 80° C. and then 1 minute at 100° C. on a hot plate in a transfix apparatus comprised of two unheated VITON ® rollers operated at 11 inches per second and designed to provide 200 to 250 psi nip pressure to paper, image, and intermediate. The paper and intermediate were then pulled apart and the intermediate was inspected for image residue. The image on the paper was evaluated for fix level as determined by optical densitometer, eraser wear resistance, crease, Taber abraset resistance, and resistance to removal by SCOTCH ® tape. SENECA ISLX ® (Image Series LX) and KROME KOTE ® papers were evaluated with this procedure. KROME KOTE ® is a specialty coated ultra-gloss paper which represents a stress test for transfix. VITON ® intermediates also represent stress tests for transfix.

The charging properties and the developability of the liquid developers were determined using a Matec electrosonic acoustic analyzer, ESA, in conjunction with particle size information determined using the Horiba CAPA 500 or 700 particle size analyzer. The ESA electrophoretic mobilities and zeta potentials relate to the developability of liquid developers using, for example, a Savin 870 photocopier. The ESA values measured for the liquid developers, prepared at 1 weight percent solids and charged with 50 milligrams of HBr Quat charge director per gram of resin solids, are summarized in Table 1. This data was selected to determine that the developers charge to a satisfactory level with HBr Quat charge director. The HBr Quat charge director was prepared as illustrated in copending application U.S. Serial No. 065,414, the disclosure of which is totally incorporated herein by reference, Example IV. Ink properties and transfix results for a variety of resins are included in the following Table.

TABLE 1

LIQUID INK PROPERTIES OF NUCREL 599 ® AND POLYALKYLENE RESINS

| RESIN | RADIUS MICRONS | Estimated % Release from B50 VITON ® | MOBILITY $M^2$/VSEC | ZETA MV | Conductivity pmho/cm |
|---|---|---|---|---|---|
| NUCREL 599 ® | 1.22 | 2-15 | $-2.3 \times 10^{-10}$ | −155 | 28 |
| Poly-1-pentene | 0.38 | 100 | $-2.40 \times 10^{-10}$ | −102 | 19 |
| Poly-1-pentene-3 wt. %-undecylenic acid | 0.60 | 98 | $-1.02 \times 10^{-10}$ | −27.1 | 19 |
| Poly-1-pentadecene | 1.01 | 100 | $-3.83 \times 10^{-11}$ | −22.1 | 25 |
| Poly-1-butene-12 wt. %-undecylenic acid | 1.30 | 95 | $-2.42 \times 10^{-10}$ | −170 | 32 |
| Poly-1-butene-22 wt. %-undecylenic acid | 0.92 | 50 | $-2.88 \times 10^{-10}$ | −141 | 29 |
| Poly-1-butene-15 wt. %-pentene-3 wt. %-undecylenic acid | 1.04 | 95 | $-1.39 \times 10^{-10}$ | −99.1 | 29 |

TABLE 1-continued

| LIQUID INK PROPERTIES OF NUCREL 599 ® AND POLYALKYLENE RESINS | | | | | |
|---|---|---|---|---|---|
| RESIN | RADIUS MICRONS | Estimated % Release from B50 VITON ® | MOBILITY $M^2$/VSEC | ZETA MV | Conductivity pmho/cm |
| Poly-1-butene-20 wt. %-pentene-3 wt. %-undecylenic acid | 1.73 | 90 | $-1.05 \times 10^{-10}$ | −128 | 24 |
| NUCREL 410 ® | 1.28 | 50 | $-2.48 \times 10^{-10}$ | −210 | 20 |
| NUCREL 035 ® | 1.20 | 60 | $-2.83 \times 10^{-10}$ | −222 | 20 |

Embodiments of the present invention include a liquid developer suitable for the formation of transfixable images, which developer is comprised of polyalkylene thermoplastic resin particles, and a charge director comprised of a protonated AB diblock copolymer; a liquid developer comprised of a liquid component, modified thermoplastic resin, and a charge director comprised of certain AB diblock copolymers; and a liquid electrostatographic developer comprised of (A) a liquid having viscosity of from about 0.5 to about 20 centipoise and a resistivity equal to or greater than about $5\times10^9$; (B) polyalkylene thermoplastic resin particles with an average volume particle diameter of from about 0.1 to about 30 microns; (C) a charge director, such as certain AB diblock copolymers as illustrated herein; and optionally (D) a charge adjuvant, and wherein (B) and (D) may be dispersed in a mixture of (A) and (C).

Liquid developers of the present invention are comprised in embodiments of a liquid component, polyalkylene thermoplastic resin, pigment and a charge director such as (1) a protonated AB diblock copolymer of poly[2-dimethylammonium-ethyl methacrylate bromide co-2-ethylhexyl methacrylate], poly[2-dimethylammonium-ethyl methacrylate tosylate co-2-ethylhexyl methacrylate], poly[2-dimethylammonium-ethyl methacrylate chloride co-2-ethylhexyl methacrylate], poly[2- dimethylammonium-ethyl methacrylate bromide co-2-ethylhexyl acrylate], poly[2-dimethylammonium-ethyl acrylate bromide co-2-ethylhexyl methacrylate], poly[2-dimethylammonium-ethyl acrylate bromide co-2-ethylhexyl acrylate], poly[2-dimethylammonium-ethyl methacrylate tosylate co-2-ethylhexyl acrylate], poly[2-dimethylammonium-ethyl acrylate tosylate co-2-ethylhexyl acrylate], poly[2-dimethylammoniumethyl methacrylate chloride co-2-ethylhexyl acrylate], poly[2-dimethylammonium-ethyl acrylate chloride co-2-ethylhexyl acrylate], poly[2-dimethylammoniumo-ethyl methacrylate bromide co-N,N-dibutyl methacrylamide], poly[2-dimethylammonium-ethyl methacrylate tosylate co-N,N-dibutyl methacrylamide], poly[2-dimethylammonium-ethyl methacrylate bromide co-N,N-dibutylacrylamide], or poly[2-dimethylammonium-ethyl methacrylate tosylate co-N,N-dibutylacrylamide]; or (2) a charge director mixture, for example 50:50, of at least two protonated AB diblock copolymers, and an optional charge adjuvant; a liquid developer comprised of a liquid component, polyalkylene thermoplastic resin; pigment; and a charge director comprised of an ammonium protonated AB diblock copolymer; and (A) a liquid having viscosity of from about 0.5 to about 20 centipoise and resistivity greater than $5\times10^9$; (B) polyalkylene thermoplastic resin particles with an average volume particle diameter of from about 0.1 to about 30 microns, and pigment; (C) a charge director such as a protonated AB diblock copolymer; and optionally (D) a charge adjuvant.

One preferred diblock copolymer selected as charge directors for the liquid developers of the present invention can be represented by the following formula

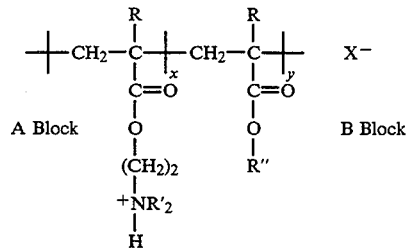

wherein the A block has a number average molecular weight of from about 200 to about 10,000 and the B block has a number average molecular weight of from about 2,000 to about 50,000 wherein the number average degree of polymerization (DP) ratio of the B block to the A block is in the range of 10 to 2 to 100 to 20; $X^-$ is an anion of any strong acid, examples of which include fluoride, chloride, bromide, iodide, trifluoroacetate, trichioroacetate, bromoacetate, p-toluene sulfonate, methane sulfonate, dodecylbenzene sulfonate, trifluoromethane sulfonate, fluoroborate, hexafluorophosphate, sulfate, bisulfate, chlorosalicylate, tetrafluoroterephthalate, tetrafluorosuccinate, and the like; and R, R′ and R″ are as illustrated herein with R″ being preferably alkyl with about 6 to about 12 carbon atoms.

Examples of specific diblock copolymer charge directors present in effective amounts of, for example, from about 0.5 to about 100 weight percent, and preferably from about 2 to about 20 percent relative to developer solids which include the alkylene thermoplastic resin, pigment and charge adjuvant in embodiments, include poly[2-dimethylammoniumethyl methacrylate bromide co-2-ethylhexyl methacrylate], poly[2-dimethylammonium-ethyl methacrylate tosylate co-2-ethylhexyl methacrylate], poly[2-dimethylammonium-ethyl methacrylate chloride co-2-ethylhexyl methacrylate], poly[2-dimethylammonium-ethyl methacrylate bromide co-2-ethylhexyl acrylate], poly[2-dimethylammonium-ethyl acrylate bromide co-2-ethylhexyl methacrylate], poly[2-dimethylammonium-ethyl acrylate bromide co-2-ethylhexyl acrylate], poly[2-dimethylammonium-ethyl methacrylate tosylate co-2ethylhexyl acrylate], poly[2-dimethylammonium-ethyl acrylate tosylate co-2-ethylhexyl acrylate], poly[2-dimethylammonium-ethyl methacrylate chloride co-2-ethylhexyl acrylate], poly[2-dimethylammonium-ethyl acrylate chloride co-2-ethylhexyl acrylate], poly[2-dimethylammoniumethyl methacrylate bromide co-N,N-dibutyl methacrylamide], poly[2-dimethylammonium-ethyl methacrylate tosylate co-N,N-dibutyl methacrylamide], poly[2-dimethylammonium-ethyl methacrylate bromide co-N,N-dibutylacrylamide], and poly[2-dimethylammonium-ethyl methacrylate tosylate co-N,N-dibutylacrylamide].

Other examples of suitable diblock copolymer charge directors include poly[4-vinyl-N,N-dimethylanilinium bromide co-2-ethylhexyl methacrylate], poly[4-vinyl-N,N-dimethylanilinium tosylate co-2-ethylhexyl methacrylate], poly[ethylenimmonium bromide co-2-ethylhexyl methacrylate], and poly[propylenimmonium bromide co-2-ethylhexyl methacrylate].

A preferred ammonium AB diblock copolymer charge director contains a polar A block in which the positive ammonium nitrogen is covalently bound to at least one hydrogen and a nonpolar B block which has sufficient aliphatic content to enable the block copolymer to more effectively dissolve in the nonpolar liquid having a Kauri-butanol value of less than 30. The A block has a number average molecular weight range of from about 200 to about 10,000 and the B block has a number average molecular weight range of from about 2,000 to 50,000. Number average degree of polymerization (DP) refers to the average number of monomeric units per polymer chain, and is related to the number average molecular weight ($M_n$) by the formula $M_n = M_0 \times DP$, where $M_0$ is the molecular weight of the monomer. Assuming an average $M_0$ of about 200 for both the A and B monomers, the above A block molecular weight ranges provide for a DP of about 1 to 50 and the above B block molecular weight ranges provide for a DP of about 10 to 250. Amine nitrogen protonation (ammonium ion formation) in the polar A block for satisfactory charge director performance should be at least 80 mole percent and preferably at least 90 mole percent. Other charge directors include di-t-butyl aluminum stearate in resin particles without WITCO 22 TM (aluminum stearate charge control agent) for positive charging liquid development systems. Examples of specific effective charge directors include anionic glyceride, such as EMPHOS D70-30C ® and EMPHOS F27-85 ®, two commercial products available from Witco Corporation, New York, NY, which are sodium salts of phosphated mono- and diglycerides with saturated and unsaturated substituents, respectively, lecithin, BASIC BARIUM PETRONATE TM, Neutral Barium Petronate, Basic Calcium Petronate, Neutral Calcium Petronate, oil soluble petroleum sulfonates, Witco Corporation., New York, NY, and metallic soap charge directors such as aluminum tristearate, aluminum distearate, barium, calcium, lead, and zinc stearates; cobalt, manganese, lead, and zinc lineolates, aluminum, calcium, and cobalt octoates; calcium and cobalt oleates; zinc palmirate; calcium, cobalt, manganese, lead, and zinc resinates, AB diblock copolymers of 2-ethylhexyl methacrylate-co-methacrylic acid calcium and ammonium salts.

The charge director can be selected for the liquid developers in various effective amounts, such as for example in embodiments from about 0.5 percent to 100 percent by weight relative to developer solids and preferably 2 percent to 20 percent by weight relative to developer solids. Developer solids includes toner resin, pigment, and charge adjuvant. Without pigment, the developer may be selected for the generation of a resist, a printing plate, and the like.

Examples of liquid carriers selected for the developers of the present invention include a liquid with an effective viscosity as measured, for example, by a number of known methods such as capillary viscometers, coaxial cylindrical rheometers, cone and plate rheometers, and the like of, for example, from about 0.5 to about 500 centipoise, and preferably from about 1 to about 20 centipoise, and a resistivity equal to or greater than $5 \times 10^9$ ohm/cm, such as $5 \times 10^{13}$. Preferably, the liquid selected is a branched chain aliphatic hydrocarbon as illustrated herein. A nonpolar liquid of the ISOPAR ® series (manufactured by the Exxon Corporation) may also be used for the developers of the present invention. These hydrocarbon liquids are considered narrow portions of isoparaffinic hydrocarbon fractions with extremely high levels of purity. For example, the boiling point range of ISOPAR G ® is between about 157° C. and about 176° C.; ISOPAR H ® is between about 176° C. and about 191° C.; ISOPAR K ® is between about 177° C. and about 197° C.; ISOPAR L ® is between about 188° C. and about 206° C.; ISOPAR M ® is between about 207° C. and about 254° C.; and ISOPAR V ® is between about 254.4° C. and about 329.4° C. ISOPAR L ® has a mid-boiling point of approximately 194° C. ISOPAR M ® has an auto-ignition temperature of 338° C. ISOPAR G ® has a flash point of 40° C. as determined by the tag closed cup method; ISOPAR H ® has a flash point of 53° C. as determined by the ASTM D-56 method; ISOPAR L ® has a flash point of 61° C. as determined by the ASTM D-56 method; and ISOPAR ®M has a flash point of 80° C. as determined by the ASTM D-56 method. The liquids selected should have an electrical volume resistivity in excess of 109 ohm-centimeters and a dielectric constant below 3.0. Moreover, the vapor pressure at 25° C. should be less than 10 Torr in embodiments.

While the ISOPAR ® series liquids are the preferred nonpolar liquids for use as dispersants in the liquid developers of the present invention, the essential characteristics of viscosity and resistivity may be achieved with other suitable liquids. Specifically, the NORPAR ® series available from Exxon Corporation, the SOLTROL ® series available from the Phillips Petroleum Company, and the SHELLSOL ® series available from the Shell Oil Company can be selected. Moreover, pentadecane, hexadecane, and other related alkanes available from HQIs and selected mineral oils available from Pennco, Inc can be selected.

The amount of the liquid employed in the developer of the present invention is, for example, from about 75 percent to about 99.9 percent, and preferably from about 95 to about 99 percent by weight of the total developer dispersion. The total solids content of the developer is, for example, 0.1 to 10 percent by weight, preferably 0.3 to 3 percent, and more preferably, 0.5 to 2.0 percent by weight.

The liquid developer of the present invention may optionally contain a colorant dispersed in the resin particles. Colorants, such as pigments or dyes like black, cyan, magenta, yellow, red, blue, green, brown, and mixtures, such as wherein any one colorant may comprise from 0.1 to 99.9 weight percent of the colorant mixture with the second, or other colorants comprising the remaining percentage thereof are preferably present to render the latent image visible.

The colorant or pigment may be present in the alkylene resin particles in an effective amount of, for example, from about 0.1 to about 60 percent, and preferably from about 1 to about 30 percent by weight based on the total weight of solids contained in the developer. The amount of colorant selected may vary depending on the use of the developer, for instance, if the toned image is to be selected to form a chemical resist image, no pigment may be necessary. Examples of pigments which may be selected include carbon blacks available from, for example, Cabot Corporation (Boston, MA), such as MONARCH ®1300, REGAL ®330, and BLACK PEARLS ®, and pigments such as FANAL PINK TM, PV FAST BLUE TM, and PALITOL YELLOW D1155 TM. Examples of pigments are illustrated in U.S. Pat. No. 5,223,368, the disclosure of which is totally incorporated herein by reference. More specifically, the following pigments may be selected.

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| P V FAST BLUE | Hoechst-Celanese | Cyan |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, C1 77266 |
| UHLICH ® BK 8200 | Paul Uhlich | Black |
| BLACK PEARLS L | Cabot | Black |

The charge on the toner particles may be measured in terms of particle mobility using a high field measurement device. Particle mobility is a measure of the velocity of a toner particle in a liquid developer divided by the size of the electric field within which the liquid developer is used. The greater the charge on a toner particle, the faster it moves through the electrical field of the development zone. The movement of the particle is important for image development add background cleaning. Toner particle mobility can be measured using the electroacoustics effect, the application of an electric field and the measurement of sound, reference U.S. Pat. No. 4,497,208, the disclosure of which is totally incorporated herein by reference. This technique is particularly useful for nonaqueous dispersions because the measurements can be accomplished at high volume loadings, for example greater than 1 weight percent. Measurements rendered by this technique have been shown to correlate with image quality, that is, for example, high mobilities have been shown to result in improved image density, higher image resolution and superior transfer efficiency, reference for example U.S. Pat. No. 5,066,821, U.S. Pat. No. 5,034,299, and U.S. Pat. No. 5,028,508, the disclosures of which are totally incorporated herein by reference. Residual conductivity, that is, the conductivity from the charge director, can be measured with a low field device as described in the Examples.

To increase the toner particle charge and, accordingly, increase the mobility and transfer latitude of the toner particles, charge adjuvants can be added to the toner particles. For example, adjuvants, such as metallic soaps like aluminum or magnesium stearate or octoate, fine particle size oxides, such as oxides of silica, alumina, titania, and the like, para-toluene sulfonic acid, and polyphosphoric acid, may be added. Negative charge adjuvants increase the negative charge of the toner particle, while the positive charge adjuvants increase the positive charge of the toner particles. With the invention of the present application, the adjuvants or charge additive can be comprised of the metal catechol and aluminum hydroxy acid complexes illustrated in U.S. Pat. No. 5,306,591 and U.S. Pat. No. 5,308,731, the disclosures of which are totally incorporated herein by reference, and/or AB diblocks enabling, for example, with the polyalkylenes improved toner charging characteristics, namely, an increase in particle charge as measured by ESA mobility of from $-1.4$ E-10 $m^2/Vs$ to $-2.3$ E-10 $m^2/Vs$, that results in improved image development and transfer, from 80 percent to nearly 100 percent, to allow improved solid area coverage from a transferred image reflectance density of 1.2 to 1.3. The adjuvants can be added to the liquid toner particles in an amount of from about 0.1 percent to about 15 percent of the total developer solids and preferably from about 1 percent to about 5 percent of the total weight of solids contained in the developer.

The liquid electrostatic developer of the present invention can be prepared by a variety of known processes, such as, for example, mixing, in a nonpolar liquid with the polyalkylene thermoplastic resin, charge director, and colorant in a manner that the resulting mixture contains about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to about 20 percent by weight; cooling the dispersion to about 10° C. to about 50° C.; adding the charge director compound to the dispersion; and diluting the dispersion to 1 percent to 2 percent solids.

In the initial mixture, the polyalkylene resin, colorant and charge director may be added separately to an appropriate vessel which can vary in size from 50 milliliters to 1,000 liters, such as, for example, an attritor, heated ball mill, heated vibratory mill, such as a Sweco Mill (manufactured by Sweco Company, Los Angeles, CA) equipped with particulate media for dispersing and grinding, a Ross double planetary mixer (manufactured by Charles Ross and Son, Hauppauge, NY), or a two roll heated mill, which requires no particulate media. Useful particulate media include materials like a spherical cylinder, such as stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters). Moreover, pigment, charge director, and thermoplastic resin can be melt mixed by extrusion, a Banbury roll mill or related melt mixing apparatus before attrition.

Sufficient nonpolar liquid can be added to provide a dispersion of from about 5 to about 50 percent solids. This mixture is then subjected to elevated temperatures during the initial mixing procedure to plasticize and soften the resin. The mixture is sufficiently heated to provide a uniform dispersion of all the solid materials of, for example, colorant, adjuvant and resin. However, the temperature at which this step is undertaken should not be so high as to degrade the nonpolar liquid or decompose the resin or colorant if present. Accordingly, the mixture in embodiments is heated to a temperature of from about 70° C. to about 130° C., and preferably from about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids concentration of the dispersion to about 10 to about 20 percent by weight.

The dispersion is then cooled to about 10° C. to about 50° C., and preferably to about 15° C. to about 30° C., while mixing is continued until the resin admixture solidifies or hardens. On cooling, the resin admixture precipitates out of the dispersant liquid. Cooling is accomplished by methods such as the use of a cooling fluid like water, glycols, such as ethylene glycol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 6 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778 and 4,783,389, the disclosures of which are totally incorporated herein by reference.

Embodiments of the invention will be illustrated in the following nonlimiting Examples, it being understood that these Examples are intended to be illustrative only and that the invention is not intended to be limited to the materials, conditions, process parameters and the like recited herein. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Ma.). The system was calibrated in the aqueous mode per manufacturer's recommendation to provide an ESA signal corresponding to a zeta potential of $-26$ millivolts for a 10 percent (v/v) suspension of LUDOX TM (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by two methods: (1) the Malvern 3600E Particle Sizer manufactured by Malvern, Southborough, MA uses laser diffraction light scattering of stirred samples to determine average particle sizes; and (2) Horiba CAPA-500 or −700 centrifugal automatic particle analyzer manufactured by Horiba Instruments, Inc, Irvine, Ca.

CONTROL 1

Preparation of Liquid Immersion Ink with NUCREL 599®:

NUCREL 599® (20 grams, ethylene-1 1-weight percent-methacrylic acid copolymer, DuPont), 3 weight percent of WITCO 22 TM (0.78 gram, Witco Chemical), 20 weight percent of PV FAST BLUE TM (5.20 grams, Hoechst/Celanese), and ISOPAR L TM (170 grams, Exxon) were heated in a Union Process O 1 attritor containing 2,400 grams of steel ⅜-inch shot until 200° F. was achieved. Heating was discontinued and ambient temperature stirring was maintained for 2 hours. Water cooling and stirring were then maintained for 4 more hours. The resin (20 grams), 3 weight percent of WITCO 22 TM (0.78 gram, Witco Chemical), 20 weight percent of PV FAST BLUE TM (5.20 grams, Hoechst/Celanese), and ISOPAR 1 TM (170 grams, Exxon) were then washed from the shot with 381.4 grams of ISOPAR L TM using a strainer, and the liquid portions comprised of 551.4 grams of ISOPAR L TM were combined. The calculated solids of the resultant ink were 4.5 weight percent. The ink when diluted to 1 weight percent solids in ISOPAR L TM and treated with HBr Quat charge director, reference the formula of application Ser. No. 065,414, the disclosure of which is totally incorporated herein by reference, Example IV, 50 milligrams per gram of resin solids, had a volume average particle radius of 1.22 microns, and a single point ESA dynamic mobility and zeta potential of $-2.27\times10^{-10}$ $m^2$/volts second and −155 millivolts, respectively. The conductivity was 28 pmho/centimeter. The transfix of a 50 percent solids image in NORPAR 15® (0.77 gram of resin, 0.20 gram of PV FAST BLUE TM and 0.03 gram of WITCO 22 TM in 1 gram of NORPAR 15®) from VITON B50® to ISLX TM paper at 250 psi nip pressure and 11 inches per second was 15 percent. The transfixed images had poor to fair fix to paper in that images could be erased with a PINK PEARL TM eraser immediately after transfix. However, image fix improved after aging for 24 hours in that the aged images could only be erased with some effort using a PINK PEARL TM Eraser. Other NUCREL® resins were formulated into inks and evaluated following the same methods used for above the NUCREL 599®. NUCREL 599® has a melting temperature at 95° C., but when plasticized with 80 weight percent of NORPAR 15® (1.4 grams), the 20 weight percent solids consisting of 0.77 gram of NUCREL 599®, 0.20 gram of PV FAST BLUE TM, and 0.03 gram of WITCO 22 TM, had a melting point of 72.3° C., as determined using differential scanning calorimetry (DSC). Developer compositions with melting points less than 75° C. are preferred for transfix of developed images to papers with heated rollers at temperatures near 100° C.

The Control 1 ink procedure was repeated with NORPAR 15 TM substituted for ISOPAR L TM. The ink when diluted to 1 weight percent solids in NORPAR 15 TM and treated with the HBr Quat charge director, 50 milligrams per gram of resin solids, had a volume average particle radius of 1.16 microns, and a single point ESA dynamic mobility and zeta potential of $-1.93\times10^{-10}$ $m^2$/ volts second and −151.6 millivolts, respectively. The conductivity was 20 pmho/centimeter. Thus, the substitution of NORPAR 15 TM for ISOPAR L TM had little effect on the electrical properties of the ink.

ESA and Particle Size Analyses. Volume average particle radii (which is one-half the particle diameter) were measured using a Horiba CAPA 500 or 700 particle size analyzer. Electrophoretic mobilities and zeta potentials were determined using an electrosonic acoustic analyzer (ESA, Matec) for the liquid inks at 1 weight percent solids in ISOPAR L TM or NORPAR 15 TM (Exxon) prepared with 50 milligrams HBr Quat per gram of resin solids. Results are summarized in Table 1. Developers with high zeta potentials and electrophoretic mobilities are expected to develop in imaging fixtures ,such as the Savin 870 photocopier, with minimal background, that is, the unwanted images are invisible without magnification.

Transfix Tests. A portion (80 grams) of the prepared liquid ink at 4.5 weight percent solids in ISOPAR L TM was concentrated using a Sorvall centrifuge (Model RC-5B, DuPont Instruments) operated at 10,000 rpms for 5 minutes and was then diluted with ISOPAR L TM to 9.2 weight percent solids. The 9.2 weight percent solids ink was then further diluted to 7.21 weight percent solids with NORPAR 15®. This mixture was draw bar gravure coated onto VITON® and dried in an 80° C. oven for 6 minutes and then at 100° C. for 1 minute in a transfix apparatus to achieve a 50 percent resin solids in NORPAR 15®, that is, 0.77 gram of NUCREL 599®, 0.20 gram of PV FAST BLUE TM and 0.03 gram of WITCO 22 TM in 1 gram of NORPAR 15®. This image was then transfixed to ISLX TM papers from VITON B50® intermediate substrate. The transfix of a 50 percent solids image in NORPAR 15® (comprised of 0.77 gram of resin, 0.20 gram of PV FAST BLUE TM and 0.03 gram of WITCO 22 TM in 1 gram of NORPAR 15®) from VITON B50® to ISLX TM paper at 250 psi nip pressure and 11 inches per second was between 2 and 15 percent.

EXAMPLE I

Preparation of Poly(97 Weight Percent-1-Pentene-3 Weight Percent-Undecylenic Acid Copolymer):

In a glove bag under argon, toluene (100 milliliters), pentene (30 grams, Aldrich Chemical Company, 1001 West Saint Paul Ave., Milwaukee, Wi., 53233) and undecylenic acid-trimethylsilyl ester (fraction 3, b.p. 115 to 120 at 0.5 millimeter Hg, 1 gram, Example }C) were combined in a 1 liter beverage bottle equipped with a magnetic stir bar. To this was added 64 milliliters of 25 weight percent of diethylaluminum chloride in toluene (Aldrich Chemical Company), more toluene (100 milliliters) and 2 teaspoons of $TiCl_3AA$ (Alfa Products, 152 Andovers St., Danvers, MA 01923). The bottle was then capped with a rubber septum, placed in an ice bath, and then placed on a magnetic stirrer. After 1 hour, the reaction mixture was quenched with methanol (100 milliliters) and added to methanol (1 liter) to precipitate a white polymer using a Waring blender. The polymer was filtered and then washed with water containing concentrated hydrochloric acid (30 milliliters diluted to 1 liter with water), and then with methanol (800 milliliters). The white resin was filtered and then vacuum dried to yield 26.3 grams of product which showed Fourier Transform Infrared (FTIR) absorbances consistent with poly(97 weight percent-1-pentene-3 weight percent-undecylenic acid) copolymer. A cyan ink was then prepared as described in Example XI. The ink when diluted to 1 weight percent solids in ISOPAR L TM and treated with HBr Quat charge director, 50 milligrams per gram of resin solids, had a volume average particle radius of 0.60 micron, and a single point ESA dynamic mobility and zeta potential of $-2.40\times10^{-10}$ $m^2$/ volts second and $-102$ millivolts, respectively. The conductivity was 19 pmho/centimeter. A high solids ink concentrate was obtained as a sediment after centrifugation for 15 minutes at 10,000 rpms using a Sorvall centrifuge (Model RC-5B, DuPont Instruments) followed by decanting off the clear fluid above the sediment. The ink, which was comprised of 80 weight percent of NORPAR 15 ®(1.0 gram), the 20 weight percent solids being comprised of 0.77 gram of resin, 0.20 gram of PV FAST BLUE TM, and 0.03 gram of WITCO 22 TM, when concentrated to 50.1 weight percent solids, was amorphous, as determined by DSC. The transfix of a 50 percent solids image in NORPAR 15 ® (solids comprised of 0.77 gram of resin, 0.20 gram of PV FAST BLUE TM and 0.03 gram of WITCO TM in 1 gram of NORPAR 15 ®) from VITON B50 ® to ISLX TM paper at 250 psi nip pressure and 11 inches per second was 98 percent. The transfixed images had good to excellent fix to paper in that images could only be erased with substantial difficulty using a PINK PEARL TM eraser immediately after transfix. Transfixed images with excellent fix to paper resisted obliteration by five strokes of a PINK PEARL TM eraser.

EXAMPLE II

Preparation of Poly(88 Weight Percent-1-Butene-12 Weight Percent-Undecylenic Acid Copolymer:

In a glove bag under argon, toluene (200 milliliters), butene (30.5 grams) and undecylenic acid-trimethyl silyl ester (4.11 grams, Example X) were combined in a 1 liter beverage bottle equipped with a magnetic stir bar. To this were added 50 milliliters of 25 weight percent diethylaluminum chloride in toluene (Aldrich), more toluene (100 milliliters) and 2 teaspoons of $TiCl_3$-AA (Alfa Products). The bottle was capped with a rubber septum and then placed in an ice bath on a magnetic stirrer. After 1 hour, the reaction mixture was quenched with methanol (100 milliliters) and added to methanol (1 liter) to precipitate the polymer using a Waring blender. The polymer was washed with water containing concentrated hydrochloric acid (30 milliliters diluted to 1 liter) and then with methanol (800 milliliters). A white resin was isolated by filtration and then vacuum dried to yield 23 grams of product which showed FTIR absorbances consistent with poly(88 weight percent-1-butene-10 weight percent-undecylenic acid) copolymer. A cyan ink was prepared as described in Example XI. The ink, when diluted to 1 weight percent solids in ISOPAR L TM and treated with the above HBr Quat charge director, reference to application Ser. No. 065,414, Example IV, 50 milligrams per gram of resin solids, had a volume average particle radius of 1.30 microns, and a single point ESA dynamic mobility and zeta potential of $-2.42\times10^{-10}$ $m^2$/ volts second and $-170.1$ millivolts, respectively. The conductivity was 32 pmho/cm. The high solids ink concentrates were obtained as sediments after centrifugation for 15 minutes at 1,000 rpms using a Sorvall centrifuge (Model RC-5B, DuPont Instruments) followed by decanting off the clear fluid above the sediment. The transfix of a 50 percent solids image in NORPAR 15 ®, which solids were comprised of 0.77 gram of resin, 0.20 gram of PV FAST BLUE TM and 0.03 gram of WITCO 22 TM in 1 gram of NORPAR 15 ®, from VITON B50 ® to ISLX TM paper at 250 psi nip pressure and 11 inches per second was 95 percent. The transfixed images had excellent fix to paper in that images could be erased only with more than five strokes of a PINK PEARL TM eraser immediately after transfix.

EXAMPLE III

Preparation of Poly(78 Weight Percent-1-Butene-22 Weight Percent-Undecylenic Acid) Copolymer;

In a glove bag under argon, toluene (200 milliliters), 1 butene (68.1 grams, Aldrich) and undecylenic acid-trimethylsilyl ester (20 grams, Example X) were combined in a 1 liter beverage bottle equipped with a magnetic stir bar. To this were added 100 milliliters of 25 weight percent diethylaluminum chloride in toluene (Aldrich), more toluene (200 milliliters) and 4 teaspoons of $TiCl_3$-AA (Alfa Products). The bottle was capped with a rubber septum, placed in an ice bath, and magnetically stirred. The undecylenic acid-trimethylsilyl ester inhibited the reaction. After 3 days, the reaction mixture was quenched with methanol and added to methanol (1 liter) using a Waring blender. The precipitated polymer was washed with water containing concentrated hydrochloric acid (30 milliliters diluted to 1 liter), and then with methanol (1.5 liters). The white resin was isolated by filtration and was then vacuum dried to yield 62.4 grams of white polymer which showed FTIR absorbances consistent with poly(78 weight percento1-butene-22 weight percent-undecylenic acid) copolymer. A cyan ink was prepared as described in Example XI. The ink when diluted to 1 weight percent solids in ISOPAR L TM and treated with HBr Quat charge director, 50 milligrams per gram of resin solids had a volume average particle radius of 0.915 micron, and a single point ESA dynamic mobility and zeta potential of $-2.88\times10^{-10}$ $m^2$/volts second and $-140.6$ millivolts, respectively. The conductivity was 29 pmho/centimeter. The high solids ink concentrate was obtained as a sediment after centrifugation for 15 minutes at 1,000 rpms using a Sorvall centrifuge (Model RC-5B, DuPont Instruments) followed by decanting off the clear supernatant fluid above the sediment. The transfix of a 50 percent solids image in NORPAR 15 ®, which solids were comprised of 0.77 gram of resin, 0.20 gram of PV FAST BLUE TM and 0.03 gram of WITCO 22 TM in 1 gram of NORPAR 15 ®, from VITON B50 ® to ISLX TM paper at 250 psi nip pressure and 11 inches per second was 50 percent. The transfixed images had excellent fix to paper in that images could be erased only with more than 6 strokes by a PINK PEARL TM eraser immediately after transfix.

EXAMPLE IV

Preparation of Poly(82 Weight Percent-1-Butene-15 Weight Percent-Pentene-3 Weight Percent-Undecylenic Acid) Copolymer:

Toluene (200 milliliters) was added to a 1 liter glass beverage bottle equipped with a stir bar. To this were added 30.2 grams of 1 butene. The septum capped bottle was chilled to 15° C. and 1.3 grams of undecylenic acid-trimethylsilyl ester (Example X) were added followed by 6.08 grams of pentene. The capped vessel was then chilled to 15° C. In a glove bag under argon, toluene (100 milliliters) and 50 milliliters of 25 weight percent diethylaluminum chloride in toluene (Aldrich) were combined in an Erhlenmeyer flask. Fifty milliliters of this solution were added to the monomers in the 1-liter beverage bottle, followed by 2 teaspoons of $TiCl_3AA$ (Alfa Products) with the use of a funnel, followed by the remaining 50 milliliters of the diethylaluminum chloride solution which was used to wash the funnel. The bottle was capped with a rubber septum, placed in an ice bath, and magnetically stirred. After 1 hour, the reaction mixture was quenched with methanol (100 milliliters) and added to methanol (800 milliliters) using a Waring blender. The precipitated polymer was filtered and washed with water containing concentrated hydrochloric acid (30 milliliters diluted to 1 liter), and then with methanol (800 milliliters). The white resin ,was filtered and then vacuum dried to yield 33.8 grams (90 percent yield) of product which showed FTIR absorbances consistent with poly(82 weight percent-1-butene-15 weight percent-pentene-3 weight percent-undecylenic acid) copolymer. The melting point of the polymer was 92.95° C. as determined using differential scanning calorimeter (DSC).

Preparation and Evaluation of Cyan LID Ink Made with Poly-82%-Butene-15%-Pentene-3%-Undecylenic Acid:

Polybutene terpolymer (10 grams), PV FAST BLUE*TM* (2.60 grams, Hoechst/Celanese), WITCO 22 TM (0.39 gram, Witco Chemical) and NORPAR 15 TM (170 grams, Exxon) were added to a Union Process O1 shot mill attritor containing 2,500 grams of ⅜-inch steel shot. The jacketed vessel was steam heated for 15 minutes at 200° F., and then stirring at ambient temperature was maintained for two hours. Stirring with jacketed water cooling was then continued for an additional four hours. The attritor shot was washed with 332.7 grams of additional NORPAR 15 TM and the ink was separated using a sieve. The calculated weight percent solids of the ink was 2.52, which was the same value obtained gravimetrically by loss on drying after heating 6 gram samples for 24 hours using a sun lamp. Thus, the ink washed from the steel shot quantitatively. The ink, when diluted to 1 weight percent solids in NORPAR 15 TM and treated with HBr Quat charge director, 50 milligrams per gram of resin solids, had a volume average particle radius of 1.04 micron, and a single point ESA dynamic mobility and zeta potential of $-1.39\times10^{-10}$ $m^2$/ volts second and −99.1 millivolts, respectively. The conductivity was 29 pmho/centimeter. The DSC melting points of the 20 weight percent solids ink concentrate of 80 weight percent of NORPAR 15 TM (4 grams) and 20 weight percent solids comprised of 0.77 gram of resin, 0.20 gram of PV FAST BLUE TM, and 0.03 gram of WITCO 22 TM were 42.2° C. (small endotherm) and 69.5° C. (larger endotherm). The high solids ink concentrate was obtained as a sediment after centrifugation for 15 minutes at 1,000 rpms using a Sorvall centrifuge (Model RC-5B, DuPont Instruments) followed by decanting off the clear fluid above the sediment. The transfix of a 50 percent solids image in NORPAR 15 ®, which solids were comprised of 0.77 gram of resin, 0.20 gram of PV FAST BLUE TM and 0.03 gram of WITCO 22 TM in 1 gram of NORPAR 15 ®from VITON B50 ® to ISLX TM paper at 250 psi nip pressure and 11 inches per second was 95 percent. The transfixed images had good fix to paper in that images could only be erased with about 6 strokes by a PINK PEARL TM eraser immediately after transfix.

EXAMPLE V

Preparation of Poly(77 Weight Percent-1-Butene-20 Weight Percent-1-Pentene-3 Weight Percent-Undecylenic Acid) Copolymer:

Toluene (200 milliliters) was added to a 1 liter glass beverage bottle equipped with a stir bar. To this was added 31.3 grams of 1 butene. The septurn capped bottle was chilled to 15° C. and 1.8 grams of undecylenic acid-trimethylsilyl ester (Example X) were added followed by the addition of 7.8 grams of pentene. The capped vessel was then chilled to 15° C. In a glove bag under argon, toluene (100 milliliters) and 50 milliliters of 25 weight percent diethylaluminum chloride in toluene (Aldrich) were combined in an Erhlenmeyer flask. Fifty milliliters of this solution were added to the above monomers in the 1 liter beverage bottle, followed by the addition of 2 teaspoons of $TiCl_3AA$ (Alfa Products) with the use of a funnel, followed by the addition of the rest of the diethylaluminum chloride solution which was used to wash the funnel. The bottle was capped with a rubber septum, placed in an ice bath, and magnetically stirred. After 1 hour, the reaction mixture was quenched with methanol (100 milliliters) and added to methanol (800 milliliters) using a Waring blender. The precipitated polymer was filtered and then washed with water containing concentrated hydrochloric acid (30 milliliters diluted to 1 liter), and then with methanol (800 milliliters). The white resin, isolated by filtration, was vacuum dried to yield 37.6 grams (92.6 percent yield) of product which showed FTIR absorbances consistent with poly(77 weight percent-1-butene-20 weight percentol-pentene-3 weight percent-undecylenic acid) copolymer. The melting point of the polymer was 87.6° C. as determined using differential scanning calorimeter (DSC).

Preparation and Evaluation of Cyan LID Ink Made with Poly-77 Percent-Buterie-20 Percent-Pentene-3 Percent-Undecylenic Acid:

Polybutene terpolymer (10 grams), PV FAST BLUE TM (2.60 grams), WITCO 22 TM (0.39 grams) and NORPAR 15 TM (170 grams) were added to a Union Process O1 shot mill attritor containing 2,500 grams of ⅜-inch steel shot and processed into a LID ink as described above. The jacketed vessel was steam heated for 15 minutes at 200° F., and then stirring at ambient temperature was maintained for two hours. Stirring with jacketed water cooling was then continued for an additional four hours. The attritor shot was washed with 364 grams of additional NORPAR 15 TM and the ink was separated using a sieve. The calculated weight percent solids of the ink was 2.39, which compares with 2.32 percent determined gravimetrically. Thus, the ink washed from the steel shot nearly quantitatively. The ink when diluted to 1 weight percent solids in NORPAR 15 TM and treated with HBr Quat charge director, reference application Ser. No. 065,414, Example IV, 50 milligrams per gram of resin solids, had a volume average particle radius of 1.73 microns, and a single point ESA dynamic mobility and zeta potential of $-1.05\times10^{-10}$ m²/volts second and −127.8 millivolts, respectively. The conductivity was 24 pmho/centimeter. The DSC melting points of the ink concentrate of 80 weight percent of NORPAR 15 TM (1.4 grams) and 20 weight percent solids comprised of 0.77 gram of resin, 0.20 gram of PV FAST BLUE TM, and 0.03 gram of WITCO 22 TM were 39.7° C. (small endotherm) and 62.9° C. (large endotherm). The high solids ink concentrates were obtained as sediments after centrifugation for 15 minutes at 1,000 rpms using a Sorvall centrifuge (Model RC-5B, DuPont Instruments) followed by decanting off the clear fluid above the sediment. The transfix of a 50 percent solids image in NORPAR 15 ®, which solids were comprised of 0.77 gram of resin, 0.20 gram of PV FAST BLUE TM and 0.03 gram of WITCO 22 TM in 1 gram of NORPAR 15 TM, from VITON B50 ®to ISLX TM paper at 250 psi nip pressure and 11 inches per second was 90 percent. The transfixed images had good fix to paper in that images could only be erased with more than five hand rubbings using a PINK PEARL TM eraser immediately after transfix.

EXAMPLE VI

Preparation of Poly-1-pentene

In a glove bag under nitrogen, toluene (400 milliliters), $TiCl_3$.AA (18 grams, Alfa Products), and 25 weight percent solution of diethylaluminum chloride in toluene (144 grams, Aldrich) were added to a 1-liter polyolefin linear high density polyethylene (HDPE) screw cap bottle. The bottle was covered with a screw-top lid, removed from the glove bag, and then situated in an ice bath for 1 hour. Pentene (95 grams) was added to the container in the glove bag, the lid was secured, and the container was rapidly returned to the ice bath with vigorous shaking. After 4 hours with periodic shaking, the exotherm subsided and the solution was added to methanol (4 liters) with 10 weight percent of concentrated hydrochloric acid using a Waring blender. The precipitated polymer was filtered and then washed with water, then with alkaline water, and then with fresh water. After another methanol wash (1 liter) the polymer was filtered and then vacuum dried. The polymer in toluene (1 liter) was washed with water using a Waring blender until the water washes were no longer turbid. After reprecipitation into methanol, the polymer was collected by filtration and vacuum dried to yield polypentene in 76.5 percent yield. The polypentene had a GPC $M_n$=26,600 and $M_w$=165,800 in THF. The DSC melting point was 80° C. A cyan ink was prepared as described in Example XI. The ink when diluted to 1 weight percent solids in ISOPAR L TM and treated with the HBr Ouat charge director, 50 milligrams per gram of resin solids, had a volume average particle radius of 0.38 micron, and a single point ESA dynamic mobility and zeta potential of $-1.02\times10^{-10}$ m²/volts second and −27.1 millivolts, respectively. The conductivity was 19 pmho/centimeter. A high solids ink concentrate was obtained as a sediment after centrifugation for 15 minutes at 10,000 rpms using a Sorvall centrifuge (Model RC-5B, DuPont Instruments) followed by decanting off the clear fluid above the sediment. The ink concentrate of 50 weight percent of NORPAR 15 TM (1.0 grams) and 50 weight percent solids comprised of 0.77 gram of resin, 0.20 gram of PV FAST BLUE TM, and 0.03 gram of WITCO 22 TM was amorphous as determined by DSC. The transfix of a 50 percent solids image in NORPAR 15 ®(consisting of 0.77 gram of resin, 0.20 gram of PV FAST BLUE TM and 0.03 gram of WITCO 22 TM in 1 gram of NORPAR 15 ®) from VITON B50 ® to ISLX TM paper at 250 psi nip pressure and 11 inches per second was 100 percent. The transfixed images had good fix to paper in that images could only be erased with more than five hand strokes-by a PINK PEARL TM eraser immediately after transfix. Throughout the Examples, strokes refers to hand strokes.

EXAMPLE VII

PREPARATION OF POLYPENTADECENE

In a glove bag under nitrogen, toluene (400 milliliters), $TiCl_3$.AA (18 grams, Alfa Products), 25 weight percent of diethylaluminum chloride in toluene (171 grams, Aldrich), and pentadecene (168 grams) were added to a 1 liter high density polyethylene screw cap bottle. The lid was secured, and the bottle was vigorously mixed. An exothermic reaction took place. After 5 hours, the container was transferred to a 40° C. oven for 64 hours. The reaction mixture was added to methanol (4 liters) with 10 percent concentrated hydrochloric acid using a Waring blender. The polymer was washed with water, then with alkaline water, and then with fresh water. After another methanol wash (1 liter), the polymer isolated by filtration was vacuum dried. The polymer in toluene (1 liter) was washed with water using a Waring blender until the water washes were no longer turbid. After reprecipitation into methanol, the polymer was collected by filtration and vacuum dried to yield polypentadecene in 85.2 percent yield. The polypentadecene had a bimodal GPC molecular weight distribution with peak 1 $M_n$=695,000 and $M_w$=1,505,370, and peak 2 $M_n$=22,795 and $M_w$=704,600 in toluene. The DSC melting point was 67° C. The resultant polymer was then dried in vacuo at 80° C. for 16 hours. The polymeric film which formed was then chopped and used for liquid ink preparation. A cyan ink was prepared as described in Example XI. The ink when diluted to 1 weight percent solids in ISOPAR L TM and treated with the HBr Quat charge director, 50 milligrams per gram of resin solids, had a volume average particle radius of 1.01 micron, and a single point ESA dynamic mobility and zeta potential of $-3.83\times10^{-11}$ m²/volts second and −22.1 millivolts, respectively. The conductivity was 25 pmho/centimeter. The DSC melting point of the ink, which consisted of 50 weight percent of NORPAR 15 TM (1.0 grams) and 50 weight percent solids comprised of 0.77 gram of resin, 0.20 gram of PV FAST BLUE TM, and 0.03 gram of WITCO 22 TM, was 43.2° C. The high solids ink concentrate was obtained as a sediment after centrifugation for 15 minutes at 10,000 rpms using a Sorvall centrifuge (Model RC-5B, DuPont-Instruments) followed by decanting off the clear fluid above the sediment. The transfix of a 50 percent solids image in NORPAR 15 ® (consisting of 0.77 gram of resin, 0.20 gram of PV FAST BLUE TM and 0.03 gram of WITCO 22 TM in 1 gram of NORPAR 15 ®) from VITON B50 ® to ISLX TM paper at 250 psi nip pressure and 11 inches per second was 100 percent. The transfixed images had excellent fix to paper in that images could only be erased with six hand rubbings using a PINK PEARL TM eraser immediately after transfix.

EXAMPLE VIII

Preparation of Polytetradecene

Polytetradecene was prepared with tetradecene (168 grams) following the above procedure used to prepare polypentadecene. The monomodal GPC $M_n=101,266$ and $M_w=832,400$. The DSC melting temperature of polytetradecene was 55° C. A cyan ink, which was prepared as described in Example XI, was evaluated following the procedure of Example XII. Transfixed images generated with a cyan ink containing this polymer could be smeared and thus were considered unacceptable.

EXAMPLE IX

Example IX involves the procedures followed above to prepare undecylenyl chloride, undecylenyl iodide, and triethylammonium undecylenyl iodide. All reagents were obtained from Aldrich unless specified otherwise. Undecylenyl iodide was made stepwise from undecylenol (Aldrich). Undecylenol was allowed to react with thionyl chloride and pyridine to form undecylenyl chloride which was then converted to undecylenyl iodide by reaction with sodium iodide in acetone or methyl ethyl ketone. Undecylenyl triethylammonium iodide was formed by the reaction of undecylenyl iodide and triethylamine in alcohol. Polyalkylenes were then made by polymerization of the corresponding 1-olefins using the isotactic catalyst $TiCl_3AA$ (Alpha Products)/diethylaluminum chloride.

Preparation of Undecylenyl Chloride

A 1-liter, 3-neck flask equipped with a mechanical stirrer, reflux condenser, argon inlet and addition funnel was placed in an oil bath at 50° C. To the flask was added methylene chloride (400 milliliters), undecylenol (100 grams) and then pyridine (55.7 grams). Thionyl chloride (78.9 grams) in methylene chloride (100 milliliters) was added dropwise under reflux over 5 hours. The mixture was filtered, the solvent was removed from the filtrate using a rotary evaporator, and the resultant oil was refiltered and then distilled using a column packed with glass Raschig rings to yield two distillate portions. The fraction collected between 100° C. and 110° C. at 1 millimeter of mercury was retained and redistiiled using a Kugelrohr apparatus available from Aldrich. The yield of undecylenyl chloride was 40 grams of oil collected between 80° C. and 85° C. at 1 millimeter of mercury, which was identified using $^{13}C$ NMR spectrometry.

Preparation of Undecylenyl Iodide in Acetone

To a 250 milliliter round bottom, 3-neck flask equipped with a mechanical stirrer, reflux condenser, and addition funnel were added sodium iodide (43.5 grams, 0.29 mole) and acetone (75 milliliters). Undecylenyl chloride (43 grams, 0.226 moles) was added dropwise and the mixture was refluxed for 16 hours. More sodium iodide (9 grams) was then added and boiling at reflux was continued for 4 days. Methylene chloride was added and the reaction mixture was filtered. Solvent was then removed from the filtrate and the residue was vacuum distilled. Two fractions were collected between 87° C. and 93° C. and between 95° C. and 98° C. at 1 millimeter of mercury. Both fractions were identified as undecylenyl iodide using $^{13}C$ NMR spectrometry.

Preparation of Triethylammonium Undecylenyl Iodide

Undecylenyl iodide (15 grams), ethanol (120 milliliters), and triethylamine (55 grams) were added to a 500 milliliter round bottom flask equipped with a reflux condenser and a mechanical stirrer. The mixture was boiled at reflux for 46 hours. Solvent was then removed using a rotary evaporator and the residue was treated with diethyl ether and hexane to yield a brown-yellow solid. The solid dissolved in toluene was treated with diethyl ether and hexane to yield a light yellow powder. After isolation by filtration and washing with diethyl ether, the powder was dried in vacuum to yield the product, triethylammonium undecylenyl iodide (12.5 grams), which was identified by $^{13}C$ NMR spectrometry.

EXAMPLE X

Preparation of Undecylenic Acid -Trimethylsilyl Ester:

To a 3-liter, 3-neck flask equipped with an addition funnel, mechanical stirrer and reflux condenser were added undecylenic acid (Lucidol, 480 grams, 2.6 mol), pyridine (240 grams, 3.03 mol) and toluene (900 milliliters). Trimethylsilyl chloride (326 grams, 3.0 mol) was then added slowly via the addition funnel over 2.5 hours. After stirring at 25° C. for 16 hours, the precipitate was filtered off and washed with toluene. The flitrates were combined and the toluene was removed using a rotary evaporator. The residue was distilled through a packed column under reduced pressure and four fractions were collected. A first cut was collected between 25° C. and 115° C. at 1 millimeter of mercury. A second cut was collected between 115° C. and 119° C. at 1 millimeter of mercury. The third cut, collected between 115° C. and 120° C. at 1 millimeter of mercury, was identified by infrared spectroscopy, and with $^{13}C$ and $^{1}H$ NMR spectrometries as the trimethylsilyl ester of undecylenic acid (320.4 grams). A fourth cut, collected between 115° C. and 121° C. at 1 millimeter of mercury, was a light-yellow oil. There was no evidence of free acid in fraction 3 using infrared spectroscopy. The carboxylic acid infrared absorption of undecylenic acid was found at 1,720 $cm^{-1}$. The trimethylsilyl ester group absorbed at 1,640 $cm^{-1}$.

EXAMPLE XI

Example XI was the general procedure followed to prepare cyan liquid immersion inks with the NUCREL® and polyalkylene resins.

Preparation of Cyan Inks

Resin (20 grams, see Table 1), 3 weight percent of WITCO 22 TM (Witco Chemical), 20 weight percent of PV FAST BLUE TM (Hoechst/Celanese), and ISOPAR L TM or NORPAR 15® (170 grams, Exxon) were heated in a Union Process 01 attritor containing stainless steel 3/16 inch chrome-coated shot (2,400 grams) until 200° F. was achieved. After 10 minutes, heating was discontinued and ambient temperature stirring was maintained for 2 hours. Water cooling and stirring was then continued for 4 more hours. The ink was then washed from the shot with approximately 270 grams of ISOPAR L TM or NORPAR 15® using a strainer, and the weight percent solids of the resultant ink was determined by loss on drying from 6 gram samples heated for 24 hours using a sun lamp. The residue of the resultant ink consisted of 20 weight percent of resin, 3 weight percent of WITCO 22 TM and 20 weight percent of PV FAST BLUE TM. The inks were evaluated as described in Example XII.

EXAMPLE XII

Transfix Tests

The inks at 9.2 weight percent resin solids containing resin (2.77 grams), pigment (PV FAST BLUE TM, 0.72 gram), charge director (WITCO 22 TM 0.108 gram), and 91.8 percent of ISOPAR L TM (35.51 grams) were obtained by concentrating more dilute inks by centrifugation and exchanging NORPAR 15 ® dispersant with three ISOPAR L TM washes. The inks were then further diluted to 7.21 weight percent solids with NORPAR 15 ®. The inks at 7.21 weight percent solids were draw bar gravure coated onto DuPont VITON GF ® or VITON B50 ® intermediate and dried in an 80° C. oven for 6 minutes and then 1 minute at 100° C. to achieve 50 percent solids in NORPAR 15 ® (i.e., 0.77 gram of resin, 0.20 gram of PV FAST BLUE TM and 0.03 gram of WITCO 22 TM in 1 gram of NORPAR 15198 ). The images on VITON GF ® or B50 ® were then passed through cold (25° C.) VITON ® rollers operated at 11 inches per second and transfixed to ISLX TM papers at 250 psi nip roller pressure. Liquid inks prepared with poly(butene-pentene-undecylenic acid) terpolymers resulted in between 90 and 95 percent image release in transfix to ISLX paper. Acceptable nonsmearing image fix similar to that obtained with NUCREL 599 ® was achieved. Image fix was excellent in that the images resisted obliteration by five strokes of a PINK PEARL TM eraser and by SCOTCH TM tape attachment and removal. Moreover, there was no image cracking when the image was creased at an 180° angle.

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer comprised of polyalkylene thermoplastic resin particles, a liquid component, pigment, a charge adjuvant and a charge director; and wherein said polyalkylene is a copolymer of butene, pentadecene and undecylenic acid.

2. A liquid developer in accordance with claim 1 wherein the charge director is a protonated AB diblock copolymer of poly,[2-dimethylammoniumethyl methacrylate bromide co-2-ethylhexyl methacrylate],poly,[2-dimethylammoniumethyl metacrylate tosylate co-2-ethylhexyl methacrylate], poly[2-dimethylammoniumethyl metacrylate chloride co-2-ethylhexyl methacrylate],poly[2-dimethylammoniumethyl methacrylate bromide co-2-ethylhexyl acrylate], poly[2dimethylammoniumethyl acrylate bromide co-2-ethylhexyl methacrylate], poly[2-dimethylammoniumethyl acrylate bromide co-2-ethylhexyl acrylate], poly[2odimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethytammoniumethyl methacrylate tosylate co-N,N-dibutyl methacrylamide], poly[2dimethylammoniumethyl methacrylate bromide co-N,Ndibutylacrylamide], or poly[2-dimethylammoniumethyl methacrylate tosylate co-N,N-dibutylacrylamide].

3. A developer in accordance with claim 1 wherein the pigment is black, cyan, magenta, yellow, red, blue, green, brown or mixtures thereof.

4. A developer in accordance with claim 1 wherein the pigment is carbon black.

5. A developer in accordance with claim 1 wherein the liquid component is an aliphatic hydrocarbon.

6. A developer in accordance with claim 5 wherein the aliphatic hydrocarbon is a mixture of branched hydrocarbons of from about 12 to about 20 carbons atoms.

7. A liquid developer comprised of polyalkylene thermoplastic resin particles, a liquid component, pigment, a charge adjuvant and a charge director; and wherein the polyalkylene is a terpolymer of butene, pentene, and undecylenic acid.

8. A liquid developer comprised of polyalkylene thermoplastic resin particles, a liquid component, pigment, a charge adjuvant and a charge director; and wherein the polyalkylene is a copolymer of polybutene, polypentene or polypentadecene with undecylenic acid derivatives of undecylenyl esters with pendant quaternary ammonium groups, or undecylenyl halide with quaternary ammonium groups.

9. An imaging method which comprises forming an electrostatic latent image followed by the development thereof with a liquid developer comprised of polyalkylene thermoplastic resin particles, a liquid component, pigment, a charge adjuvant and a charge director; and wherein said polyalkylene is a copolymer of butene, pentene, or pentadecene and undecylenic acid.

* * * * *